US007021192B2

(12) United States Patent
Kita et al.

(10) Patent No.: US 7,021,192 B2
(45) Date of Patent: Apr. 4, 2006

(54) CYLINDER APPARATUS

(75) Inventors: Kazushi Kita, Kitakatsushika-gun (JP); Jun Yamada, Ushiku (JP); Kazufumi Waki, Moriya (JP); Kouhei Toyohara, Abiko (JP); Yuuya Osamura, Tsukuba-gun (JP)

(73) Assignee: SMC Kabushiki Kaisha, Tokyo (JP)

( * ) Notice: Subject to any disclaimer, the term of this patent is extended or adjusted under 35 U.S.C. 154(b) by 80 days.

(21) Appl. No.: 10/784,985

(22) Filed: Feb. 25, 2004

(65) Prior Publication Data

US 2004/0237774 A1 Dec. 2, 2004

(30) Foreign Application Priority Data

Mar. 7, 2003 (JP) ..... 2003-061920

(51) Int. Cl.
*F15B 15/22* (2006.01)

(52) U.S. Cl. ..... 91/394; 91/408; 92/85 B; 251/219

(58) Field of Classification Search ..... 91/394, 91/407, 408; 92/85 R, 85 B; 251/219, 122
See application file for complete search history.

(56) References Cited

U.S. PATENT DOCUMENTS 429,881 A * 6/1890 Bowman ..... 251/219
1,362,986 A * 12/1920 Dunham ..... 251/219
1,880,177 A * 9/1932 Kohler et al. ..... 251/219
1,975,030 A * 9/1934 Wheelhouse ..... 251/219
2,167,433 A * 7/1939 Bethune ..... 251/219
2,710,595 A * 6/1955 Peterson et al. ..... 91/394
3,238,850 A * 3/1966 Yves ..... 91/394
3,337,183 A * 8/1967 Horneck et al. ..... 251/219
3,805,672 A * 4/1974 Pekrul ..... 92/85 R
6,170,797 B1 1/2001 Kimura et al.

FOREIGN PATENT DOCUMENTS

DE 202 19 693 U1 3/2003
EP 1 132 629 9/2001
EP 1 199 479 4/2002

OTHER PUBLICATIONS

JIS Handbook, JIS B 8377-1981 (p. 538, Fig. 2).

* cited by examiner

*Primary Examiner*—Edward K. Look
*Assistant Examiner*—Michael Leslie
(74) *Attorney, Agent, or Firm*—Paul A. Guss

(57) ABSTRACT

A pair of throttle valves are installed to first and second installation holes of a cylinder tube, respectively. The throttle valve comprises a rotatable member, a needle which is engaged with the rotatable member and which controls the flow rate of a pressure fluid flowing through first and second bypass passages formed in each of the first and second installation holes, a covering member which covers each of said first and second installation holes, and a stopper ring which prevents the displacement of the rotatable member.

18 Claims, 8 Drawing Sheets

CYLINDER APPARATUS

BACKGROUND OF THE INVENTION

1. Field of the Invention

The present invention relates to a cylinder apparatus which has a cushion mechanism capable of changing the displacement speed of a piston around an end of displacement thereof. The piston is displaceable in the axial direction in a cylinder body.

2. Description of the Related Art

A cylinder apparatus driven by a pressure fluid is used as a driving mechanism for transporting and positioning a workpiece or driving a variety of industrial machines.

As shown in FIG. 8, the cylinder apparatus comprises a piston 2 which is provided displaceably in a cylinder body 1. An elongate piston rod 3 is connected to the piston 2. A head cover 4*a* and a rod cover 4*b* are connected to ends of the cylinder body 1, and the ends of the cylinder body 1 are closed thereby. Pressure fluid ports 5*a*, 5*b*, through which the pressure fluid is supplied and discharged, are formed in the head cover 4*a* and the rod cover 4*b*, respectively. The piston 2 is displaced in the axial direction by the pressure fluid supplied from the pressure fluid ports 5*a*, 5*b* to a cylinder chamber 6 in the cylinder body 1.

Cushion valves 7*a*, 7*b* are provided for the head cover 4*a* and the rod cover 4*b*, each of which controls the flow rate of the pressure fluid discharged from the cylinder chamber 6.

The head cover 4*a* and the rod cover 4*b* are provided with check valves 8*a*, 8*b* which are disposed in the vicinity of the cushion valves 7*a*, 7*b*.

First communication passages 9*a* are formed so that the cylinder chambers 6 communicate with holes in which the cushion valves 7*a*, 7*b* are provided. The holes communicate with the interiors of the head cover 4*a* and the rod cover 4*b* into which the piston rod 3 is inserted.

Second communication passages 9*b* are formed so that the cylinder chambers 6 communicate with holes in which the check valves 8*a*, 8*b* are provided. The holes communicate with the interiors of the head cover 4*a* and the rod cover 4*b* into which the piston rod 3 is inserted.

The cushion valves 7*a*, 7*b* can be screwed by the screw sections with respect to the head cover 4*a* and the rod cover 4*b*. When the cushion valves 7*a*, 7*b* are screwed, the cushion valves 7*a*, 7*b* are displaced in the direction substantially perpendicular to the axis of the cylinder body 1. The cross-sectional areas of the flow passages for the pressure fluid flowing through the first communication passages 9*a* are changed by the ends of the cushion valves 7*a*, 7*b* when the cushion valves 7*a*, 7*b* are displaced to adjust the flow rates of the pressure fluid to be discharged to the outside from the pressure fluid ports 5*a*, 5*b* via the first communication passages 9*a*.

When the pressure fluid is supplied from one pressure fluid port 5*b* near the rod cover 4*b*, for example, the piston 2 is displaced toward the head cover 4*a* together with the piston rod 3. During this process, the pressure fluid remaining in the cylinder chamber 6 disposed near the head cover 4*a* is discharged to the outside from the pressure fluid port 5*a* via the interior of the head cover 4*a* into which the end of the piston rod 3 is inserted when the piston 2 is displaced.

When the end of the piston rod 3 is inserted into the head cover 4*a*, the pressure fluid is discharged from the pressure fluid port 5*a* via the first communication passage 9*a*. The displacement speed of the piston 2 is decelerated by adjusting the discharge amounts of the pressure fluid flowing through the first communication passages 9*a* by screwing the cushion valves 7*a*, 7*b* as described above (see, for example, "JIS Handbook", JIS B 8377-1981 (p. 538, FIG. 2)).

In the case of the cylinder apparatus disclosed in "JIS Handbook", JIS B 8377-1981 (p. 538, FIG. 2), the flow rates of the pressure fluid to be discharged from the first communication passages 9*a* are adjusted by screwing the cushion valves 7*a*, 7*b* provided in the head cover 4*a* and the rod cover 4*b*, respectively, to change the displacement speed of the piston 2 which is displaced in the cylinder body 1. Thus, the piston 2 is prevented from the collision with the head cover 4*a* or the rod cover 4*b* by cushioning.

However, in the conventional apparatus, when the displacement speed of the piston 2 is adjusted by using the cushion valves 7*a*, 7*b*, the cushion valves 7*a*, 7*b* are displaced in the axial direction. Therefore, for example, the cushion valves 7*a*, 7*b* are recessed by predetermined depths from the side surface of the cylinder body 1. When the cylinder apparatus is used in an environment in which liquid or the like is used in the vicinity of the cylinder apparatus, the liquid and the dust or the like are remained in the holes in which the cushion valves 7*a*, 7*b* are installed.

SUMMARY OF THE INVENTION

A general object of the present invention is to provide a cylinder apparatus which makes it possible to prevent a rotatable member from being recessed with respect to a cylinder body when the displacement speed is adjusted around an end of displacement of a piston by using the rotatable member and an adjusting member installed to a cover member and/or the cylinder body.

A principal object of the present invention is to provide a cylinder apparatus which makes it possible to avoid any liquid pool or the like on an outer surface of a cylinder body even when the cylinder apparatus is used in an environment in which liquid or the like is used.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

Figure 1:
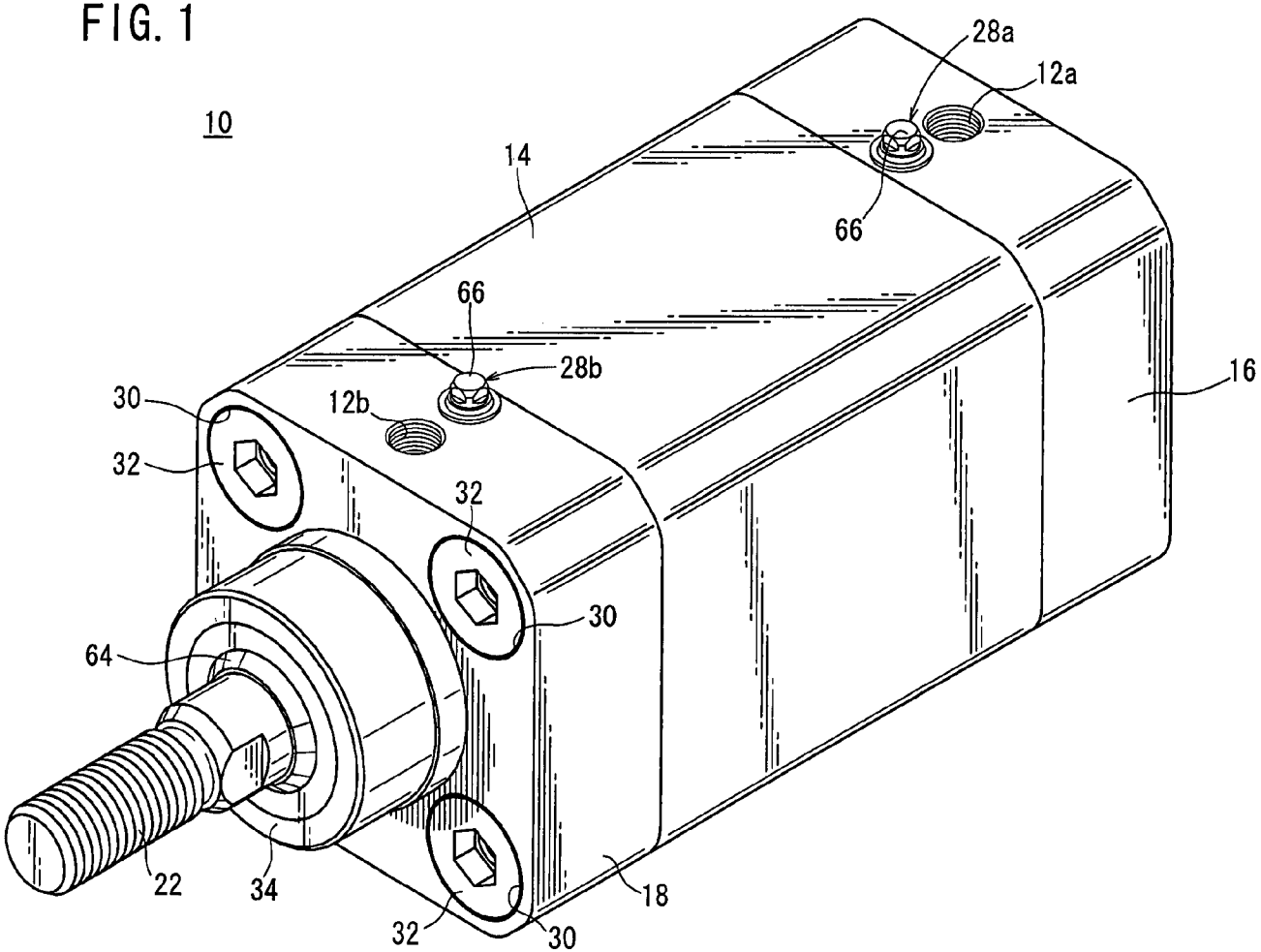
FIG. 1 is a perspective view illustrating a cylinder apparatus according to an embodiment of the present invention.

With reference to FIG. 1, reference numeral 10 indicates a cylinder apparatus according to an embodiment of the present invention.

The cylinder apparatus 10 has a cylindrical shape. The cylinder apparatus 10 comprises a cylinder tube (cylinder body) 14 in which a first port 12*a* and a second port 12*b* are formed to supply and discharge the pressure fluid, a head cover (cover member) 16 which is secured to one end of the cylinder tube 14, a rod cover (cover member) 18 which is secured to the other end of the cylinder tube 14, a piston 20 (see FIG. 2) which is displaceable in the axial direction in the cylinder tube 14, a piston rod 22 which is connected penetratingly through the piston 20, and a pair of throttle valves 28*a*, 28*b* which function as cushion mechanisms for adjusting the displacement speeds of the piston 20 around the ends of displacement.

The cylinder tube 14 is not limited to the structure in which the head cover 16 and the rod cover 18 are secured to the ends of the cylinder tube 14. One end thereof may be closed by a cylinder tube, and only the other end thereof may be closed by a cover member or the like.

The first port 12*a* and the second port 12*b* are formed on the upper surface of the cylinder tube 14. The pressure fluid is supplied from an unillustrated pressure fluid supply source to the first port 12*a* or the second port 12*b*, and the pressure fluid contained in the cylinder tube 14 is discharged from the first port 12*a* or the second port 12*b*. The first and second ports 12*a*, 12*b* are separated from each other by a predetermined distance, and are arranged on a straight line. First and second installation holes 26*a*, 26*b* (see FIG. 2) are separated from the first port 12*a* and the second port 12*b* by predetermined distances, respectively. The first and second ports 12*a*, 12*b* are not limited to the structure in which they are arranged on the straight line.

The first and second installation holes 26*a*, 26*b* are arranged on the straight line with respect to the first port 12*a* and the second port 12*b*. The throttle valves 28*a*, 28*b* are arranged in the first and second installation holes 26*a*, 26*b*, respectively. The first and second installation holes 26*a*, 26*b*, are not limited to the structure in which they are arranged on the straight line. Similarly, the throttle valves 28*a*, 28*b*, which are installed to the first and second installation holes 26*a*, 26*b*, are also not limited to the structure in which they are arranged on the straight line.

Further, the throttle valves 28*a*, 28*b* are not limited to the structure in which they are installed to the head cover 16 and the rod cover 18. Installation holes may be formed in the cylinder tube 14, and the throttle valves 28*a*, 28*b* may be installed thereto.

Each of the head cover 16 and the rod cover 18 is installed to the end of the cylinder tube 14 by attachment bolts 32 which are inserted into holes 30 formed at four corners thereof. A rod guide 34 is screwed in the end of the rod cover 18, and supports the piston rod 22.

Figure 2:
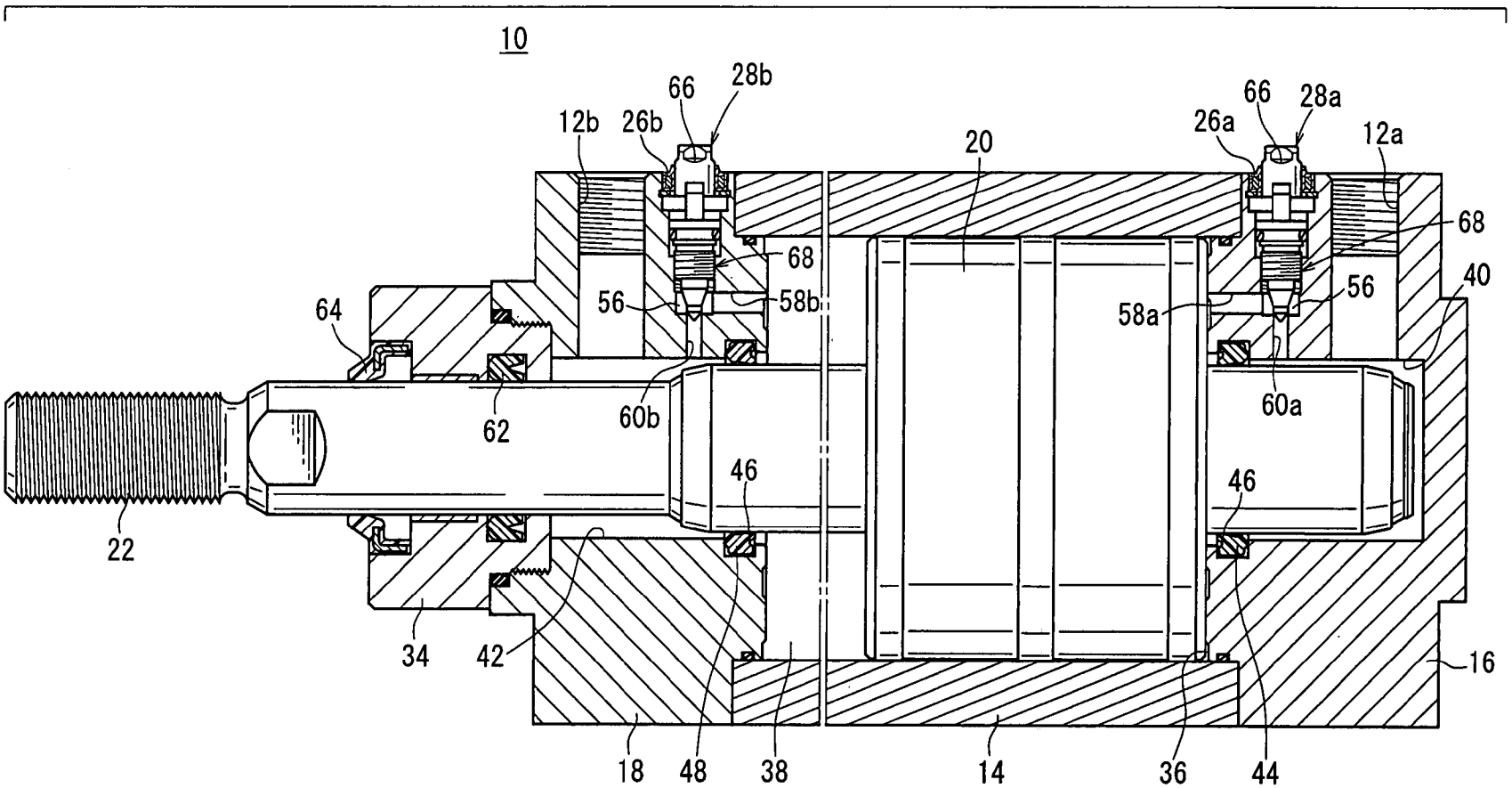
FIG. 2 is, with partial omission, a longitudinal sectional view illustrating the cylinder apparatus shown in FIG. 1.

As shown in FIG. 2, a first cylinder chamber 36 is formed between the head cover 16 and one end of the piston 20 in the cylinder tube 14, and a second cylinder chamber 38 is formed between the rod cover 18 and the other end of the piston 20. The first cylinder chamber 36 communicates with the first port 12*a* via a first communication chamber 40 in the head cover 16. The second cylinder chamber 38 communicates with the second port 12*b* via a second communication chamber 42.

The first end of the piston rod 22 is inserted into the first communication chamber 40. The outer circumferential surface of the piston rod 22 is surrounded by a first rod packing 44 which is installed to an annular groove formed on the inner circumferential surface of the first communication chamber 40. A lip section 46 is formed on the inner circumferential side of the first rod packing 44. The lip section 46 is inclined by a predetermined angle toward the first cylinder chamber 36. The inner circumferential surface of the lip section 46 abuts against the outer circumferential surface of the piston rod 22.

Accordingly, the pressure fluid from the first port 12*a* flows into the first cylinder chamber 36 via the first communication chamber 40. The lip section 46 prevents the pressure fluid from flowing from the first cylinder chamber 36 toward the first communication chamber 40.

The second end of the piston rod 22 is inserted into the second communication chamber 42. The outer circumferential surface of the piston rod 22 is surrounded by a second rod packing 48 which is installed to an annular groove formed on the inner circumferential surface of the second communication chamber 42. A lip section 46 is formed on the inner circumferential side of the second rod packing 48. The lip section 46 is inclined by a predetermined angle toward the second cylinder chamber 38. The inner circumferential surface of the lip section 46 abuts against the outer circumferential surface of the piston rod 22.

Accordingly, the pressure fluid from the second port 12*b* flows into the second cylinder chamber 38 via the second communication chamber 42. The lip section 46 prevents the pressure fluid from flowing from the second cylinder chamber 38 toward the second communication chamber 42.

Figure 3:
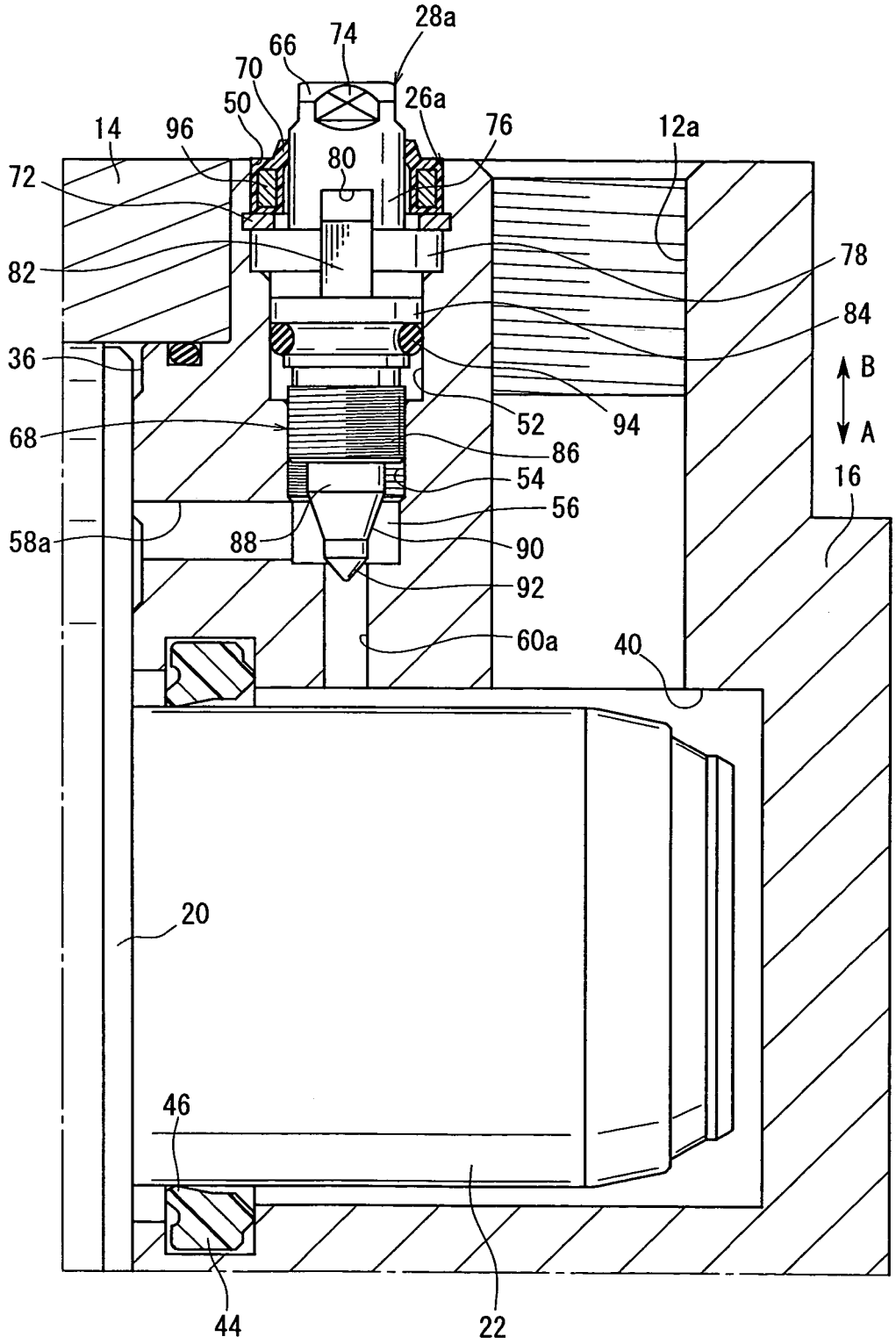
FIG. 3 is a partial magnified longitudinal sectional view mainly illustrating a throttle valve of the cylinder apparatus shown in FIG. 2.

As shown in FIG. 3, each of the first and second installation holes 26*a*, 26*b* includes a first hole section 50 which is formed on the surface of the cover member (i.e., head cover 16 and rod cover 18 ), a second hole section 52 which is formed under the first hole section 50 while being diametrally reduced, a female thread section 54 which is formed under the second hole section 52 while being slightly diametrally reduced and which has a thread on the inner circumferential surface, and a communicating section 56 which is formed under the female thread section 54 and which communicates with first bypass passages 58*a*, 58*b* and second bypass passages 60*a*, 60*b* as described later on.

As shown in FIG. 2, the first and second installation holes 26*a*, 26*b* are formed with the first bypass passages 58*a*, 58*b* which extend substantially in parallel to the axis of the piston rod 22 from the inner circumferential surface thereof, and the second bypass passages 60*a*, 60*b* which extend substantially perpendicularly to the axis of the piston rod 22 from the lower end of each of the first and second installation holes 26*a*, 26*b*.

That is, the first and second installation holes 26*a*, 26*b* communicates with the first and second cylinder chambers 36, 36 via the first bypass passages 58*a*, 58*b*, respectively; and the first and second installation holes 26*a*, 26*b* communicates with the first and second communication chambers 40, 42 via the second bypass passages 60*a*, 60*b*, respectively.

The rod guide 34 is integrally connected by being screwed with the rod cover 18 at one end thereof. A hole is formed in the rod guide 34, through which the second end of the piston rod 22 is inserted displaceably in the axial direction.

A seal member 62 is installed to an annular groove formed on the inner circumferential surface of the rod guide 34. The seal member 62 abuts against the outer circumferential surface of the piston rod 22. Therefore, air-tightness is preferably retained for the pressure fluid contained in the cylinder tube 14.

A scraper 64 is installed to an annular groove formed at the other end of the rod guide 34. The scraper 64 prevents the dust or the like adhered when the piston rod 22 is exposed from the cylinder apparatus 10 from entering the cylinder tube 14.

The pair of throttle valves 28*a*, 28*b* are arranged in the first and second installation holes 26*a*, 26*b* formed at the upper surface of the cylinder tube 14, respectively, and function as the cushion mechanisms.

Figure 4:
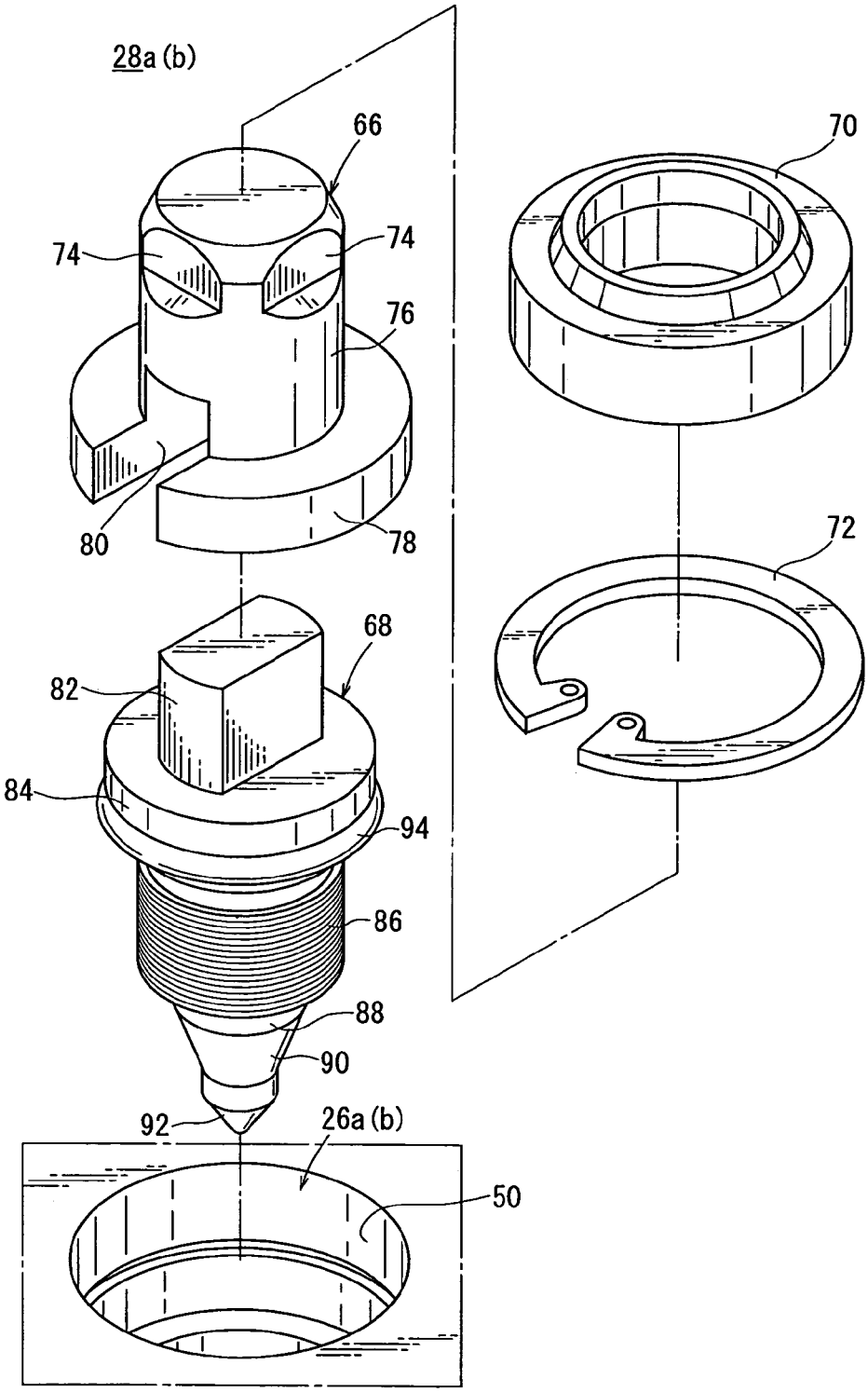
FIG. 4 is a magnified exploded perspective view illustrating the throttle valve shown in FIG. 2.

As shown in FIGS. 3 and 4, each of the throttle valves 28*a*, 28*b* comprises a rotatable member 66 which is arranged at an upper position and which has a substantially T-shaped cross section, a needle (adjusting member) 68 which has an upper end to be engaged with a substantially central portion of the rotatable member 66 and which has a lower end in a tapered shape, a ring-shaped covering member 70 which is installed between the inner circumferential surface of each of the first and second installation holes 26*a*, 26*b* and the outer circumferential surface of the rotatable member 66, and a stopper ring (fastening member) 72 which has a substantially C-shaped cross section and which is engageable with an outer circumferential portion of the needle 68.

The rotatable member 66 is arranged in the first hole section 50 of each of the first and second installation holes 26*a*, 26*b*. As shown in FIG. 4, the rotatable member 66 comprises a substantially columnar holding section 76 which is formed with cutout grooves 74 by predetermined depths on the outer circumferential surface, a flange section 78 which is formed under the holding section 76 and which is expanded radially outwardly, and an engaging recess 80 with which an engaging projection 82 of the needle 68 is engageable as described later on.

Four cutout grooves 74 are formed at intervals of about 90° circumferentially at upper portions of the holding section 76. When the cutout grooves 74 are gripped with an unillustrated tool or the like, it is possible to preferably rotate the rotatable member 66.

As shown in FIG. 3, the outer circumferential diameter of the flange section 78 is substantially equal to the inner circumferential diameter of the first hole section 50. When the rotatable member 66 is installed in the first hole section 50, the lower surface of the flange section 78 abuts against the bottom surface of the first hole section 50. When the stopper ring 72 is installed to an annular groove formed on the inner circumferential surface of the first hole section 50, the upward displacement of the rotatable member 66 is prevented thereby.

Accordingly, the rotatable member 66 is held between the bottom surface of the first hole section 50 and the stopper ring 72. Therefore, the displacement of the rotatable member 66 in the axial direction (direction of the arrow A or B shown in FIG. 3) is prevented. Each of the throttle valves 28*a*, 28*b* including the rotatable member 66 is prevented from disengagement to the outside from the inside of each of the first and second installation holes 26*a*, 26*b*.

As shown in FIG. 4, the stopper ring 72 has a substantially C-shaped cross section, and it is installed to the annular groove of the first hole section 50 by the repulsive force thereof (see FIG. 3).

As shown in FIG. 3, the engaging recess 80 is formed at a substantially central portion of the rotatable member 66. The engaging recess 80 is formed while being recessed by a predetermined depth toward the holding section 76 from the end surface of the flange section 78. The engaging recess 80 has a substantially rectangular shape corresponding to the shape of the engaging projection 82. The engaging projection 82 of the needle 68 is inserted displaceably in the axial direction into the engaging recess 80.

The engaging recess 80 has a predetermined depth. Thus, even when the needle 68 is displaced to the uppermost position, there is a predetermined clearance between the upper end of the engaging projection 82 of the needle 68 and the upper surface of the engaging recess 80.

As shown in FIGS. 3 and 4, the needle 68 comprises the substantially rectangular engaging projection 82 which protrudes upwardly by a predetermined length, a guide section 84 which is formed under the engaging projection 82 and which has its outer circumferential surface to abut against the inner circumferential surface of each of the first and second installation holes 26*a*, 26*b*, a screw section 86 which has a thread on the outer circumferential portion and which is engageable with the female thread section 54 of each of the first and second installation holes 26*a*, 26*b*, a shaft section 88 which is diametrally reduced radially inwardly as compared with the screw section 86, a first tapered section 90 which is diametrally reduced stepwise downwardly from the shaft section 88, and a second tapered section 92 which is further diametrally reduced as compared with the first tapered section 90. A seal member 94 is installed to an annular groove which is formed between the guide section 84 and the screw section 86.

The engaging projection 82 is inserted into the engaging recess 80 which is formed corresponding to the outer shape of the engaging projection 82. Therefore, when the rotatable member 66 is rotated, the rotatable member 66 and the needle 68 are rotated integrally since the engaging projection 82 and the engaging recess 80 are engaged.

The guide section 84 is formed so that the outer circumferential surface thereof abuts against the inner circumferential surface of each of the first and second installation holes 26*a*, 26*b*. Therefore, the needle 68 slides in the axial direction in each of the first and second installation holes 26*a*, 26*b* as guided by the guide section 84. During this movement, air-tightness is reliably retained in each of the first and second installation holes 26*a*, 26*b* by the seal member 94 installed to the annular groove.

The screw section 86 having the thread on the outer circumferential surface is formed at the substantially central portion of the needle 68 in the axial direction. The screw section 86 is screwed with the female thread section 54 of each of the first and second installation holes 26*a*, 26*b*. That is, when the needle 68 is rotated, the needle 68 is displaced in the axial direction in each of the first and second installation holes 26*a*, 26*b* by the screwing of the screw section 86.

The first tapered section 90 is provided under the screw section 86 via the shaft section 88 which is reduced radially inwardly as compared with the screw section 86. The first tapered section 90 is diametrally reduced gradually in the downward direction.

The second tapered section 92 is further diametrally reduced as compared with the first tapered section 90. The second tapered section 92 is arranged so that the second tapered section 92 is opposed to the opening of each of the second bypass passages 60*a*, 60*b* (see FIG. 3).

That is, the cross-sectional area of the flow passage at the opening of the second bypass passage 60 can be changed by the tapered surface of the second tapered section 92 when the needle 68 is displaced in the axial direction. Accordingly, when the needle 68 is displaced in the axial direction, it is possible to control the flow rate of the pressure fluid flowing through each of the first bypass passages 58*a*, 58*b* and the second bypass passages 60*a*, 60*b*.

The annular covering member 70 is installed to the upper portion of the first hole section 50 of each of the first and second installation holes 26*a*, 26*b* so that the holding section 76 of the rotatable member 66 is surrounded thereby. The covering member 70 is formed of an elastic material such as nitrile rubber (NBR). An annular ring member 96 of a metal material is contained in the covering member 70 (see FIG. 3).

That is, when the ring member 96 is provided in the covering member 70, the rigidity is increased at the portion of installation to the outer circumference of the holding section 76. Thus, the rotatable member 66 and each of the first and second installation holes 26*a*, 26*b* are sealed more reliably.

The cylinder apparatus 10 according to the embodiment of the present invention is basically constructed as described above. Next, its operation, function, and effect will be explained.

The pressure fluid (for example, compressed air) is supplied from the unillustrated pressure fluid supply source to the first port 12*a*. As shown in FIG. 2, the pressure fluid, which is supplied to the first port 12*a*, flows into the first cylinder chamber 36 via the first communication chamber 40. The piston 20 arranged in the first cylinder chamber 36 is pressed toward the rod cover 18. In this situation, the second port 12*b* is opened to the atmospheric air. Therefore, the pressure fluid in the second cylinder chamber 38 is discharged to the outside from the second port 12*b* via the second communication chamber 42. The end surface of the piston 20 abuts against the end surface of the rod cover 18, and the piston 20 stops at one end of displacement.

When the piston 20, which has been displaced toward the rod cover 18, is displaced toward the head cover 16 reversely to the above, the first port 12*a* is opened to the atmospheric air, and the pressure fluid is supplied from the second port 12*b*. The pressure fluid supplied to the second port 12*b* flows into the second cylinder chamber 38 via the second communication chamber 42. The piston 20 arranged in the second cylinder chamber 38 is pressed toward the head cover 16. In this situation, the first port 12*a* is opened to the atmospheric air. Therefore, the pressure fluid in the first cylinder chamber 36 is discharged to the outside from the first port 12*a* via the first communication chamber 40. The end surface of the piston 20 abuts against the end surface of the head cover 16, and the piston 20 stops at the other end of displacement.

Next, an explanation will be made about a process in which cushioning is exhibited by adjusting the displacement speed of the piston 20 displaceable in the axial direction in the cylinder tube 14 by using the throttle valve 28*a*, 28*b*. The explanation will now be made about a procedure in which the throttle valve 28*a*, which is installed to the first installation hole 26*a*, is adjusted to change the displacement speed when the piston 20 is displaced in the direction toward the head cover 16.

At first, the cutout grooves 74 of the holding section 76 of the throttle valve 28*a* are gripped by an unillustrated tool or the like to rotate the rotatable member 66 in the circumferential direction. The needle 68 is rotated by the engaging projection 82 engaged with the engaging recess 80 of the rotatable member 66 when the rotatable member 66 is rotated. Accordingly, the needle 68 is displaced in the axial direction by screwing action, because the needle 68 is screwed with the female thread section 54 of the first installation hole 26*a* by the screw section 86.

During this process, as the needle 68 is displaced in the axial direction, the engaging projection 82 is displaced in the axial direction in the engaging recess 80. In this situation, the rotatable member 66 is not displaced in the axial direction, because the rotatable member 66 is held between the stopper ring 72 and the bottom surface of the first hole section 50. Therefore, the amount of protrusion of the rotatable member 66 from the upper surface of the cylinder tube 14 is always constant.

That is, the depth of the engaging recess 80 of the rotatable member 66 is previously set. Thus, the upper end of the engaging projection 82 does not contact the upper surface of the engaging recess 80 even when the needle 68 is displaced upwardly in the axial direction. Therefore, the rotatable member 66 is not pressed upwardly when the needle 68 is displaced in the axial direction.

During this process, for example, when it is intended to decrease the displacement speed of the piston 20, the rotatable member 66 is screwed so that the needle 68 is displaced in the direction toward the center of the cylinder tube 14 (direction of the arrow A) as shown in FIG. 3. When it is intended to increase the displacement speed of the piston 20 reversely to the above, the rotatable member 66 is screwed so that the needle 68 is displaced in the direction to separate from the center of the cylinder tube 14 (direction of the arrow B).

As a result, the distance between the opening of the second bypass passage 60*a* and the second tapered section 92 of the needle 68 is changed. That is, the clearance can be changed between the opening of the second bypass passage 60*a* and the second tapered section 92, and thus it is possible to adjust the flow rate of the pressure fluid flowing through the first and second bypass passages 58*a*, 60*a*.

In other words, it is possible to adjust the flow rate of the pressure fluid to be discharged from the first cylinder chamber 36 via the first port 12*a*.

When the throttle valve 28*a*, which functions as the cushion mechanism, is used to arbitrarily set the flow rate of the pressure fluid flowing through the first and second bypass passages 58*a*, 60*a* of the first installation hole 26*a*, the pressure fluid from the second port 12*b* flows into the second cylinder chamber 38 via the second communication chamber 42 as shown in FIG. 2, and the piston 20 is pressed toward the head cover 16.

Figure 5:
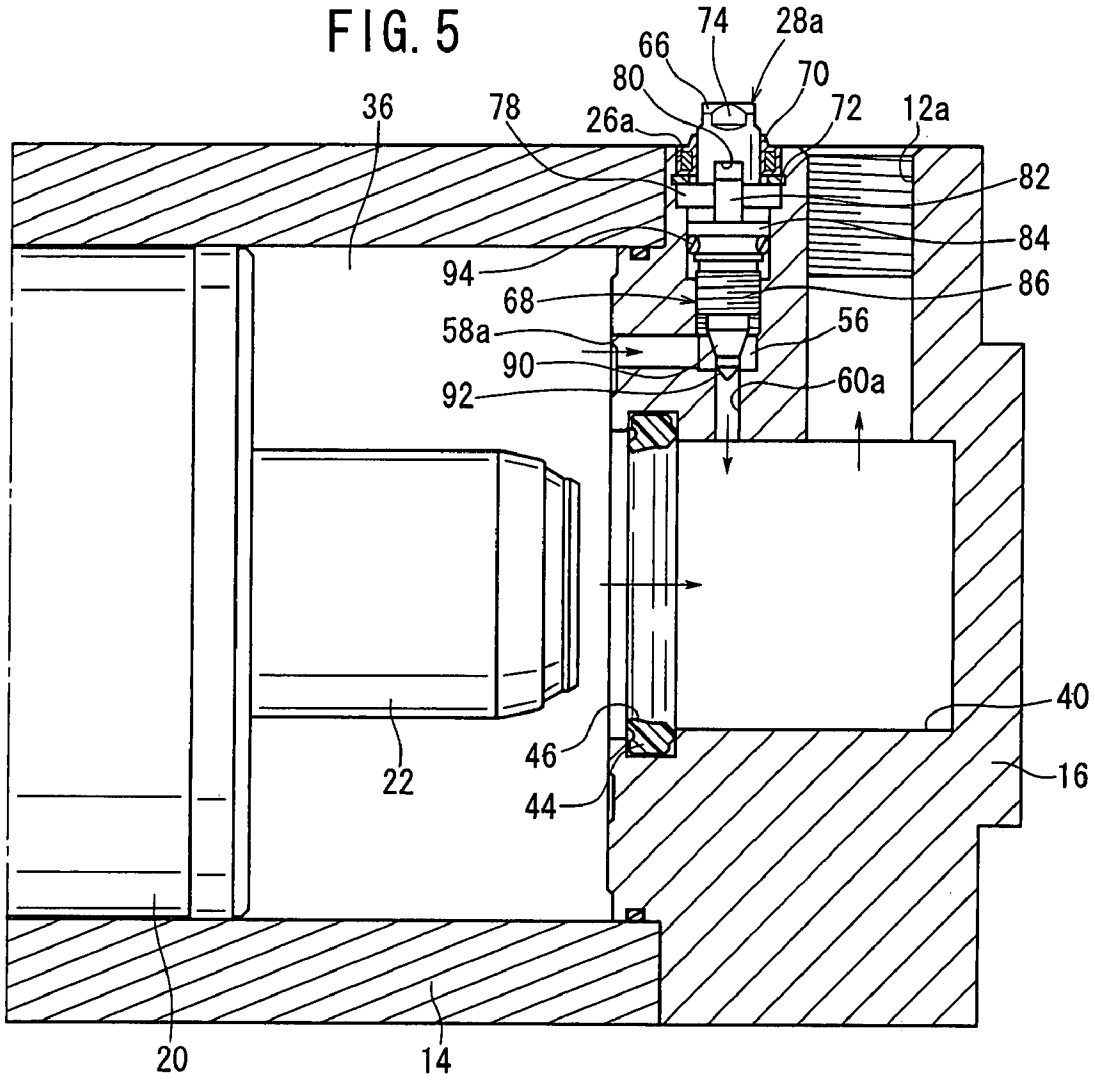
FIG. 5 is a partial magnified longitudinal sectional view showing that a piston of the cylinder apparatus shown in FIG. 2 is displaced toward a rod cover and abuts against the rod cover.

During this process, as shown in FIG. 5, the pressure fluid in the first cylinder chamber 36 is discharged to the outside from the first port 12*a* via the first communication chamber 40 when the piston 20 is displaced. At the same time, the pressure fluid flows into the communicating section 56 via the first bypass passage 58*a* communicated with the first cylinder chamber 36. The pressure fluid flows into the first communication chamber 40 via the clearance between the second tapered section 92 of the needle 68 and the second bypass passage 60*a*, and the pressure fluid is discharged to the outside from the first port 12*a* via the first communication chamber 40.

That is, as shown in FIG. 5, when the pressure fluid in the first cylinder chamber 36 is discharged in accordance with the displacement of the piston 20, the pressure fluid is directly discharged via the first communication chamber 40, and the pressure fluid is discharged from the first port 12*a* via the first and second bypass passages 58*a*, 60*a* arranged with the throttle valve 28*a*.

Figure 6:
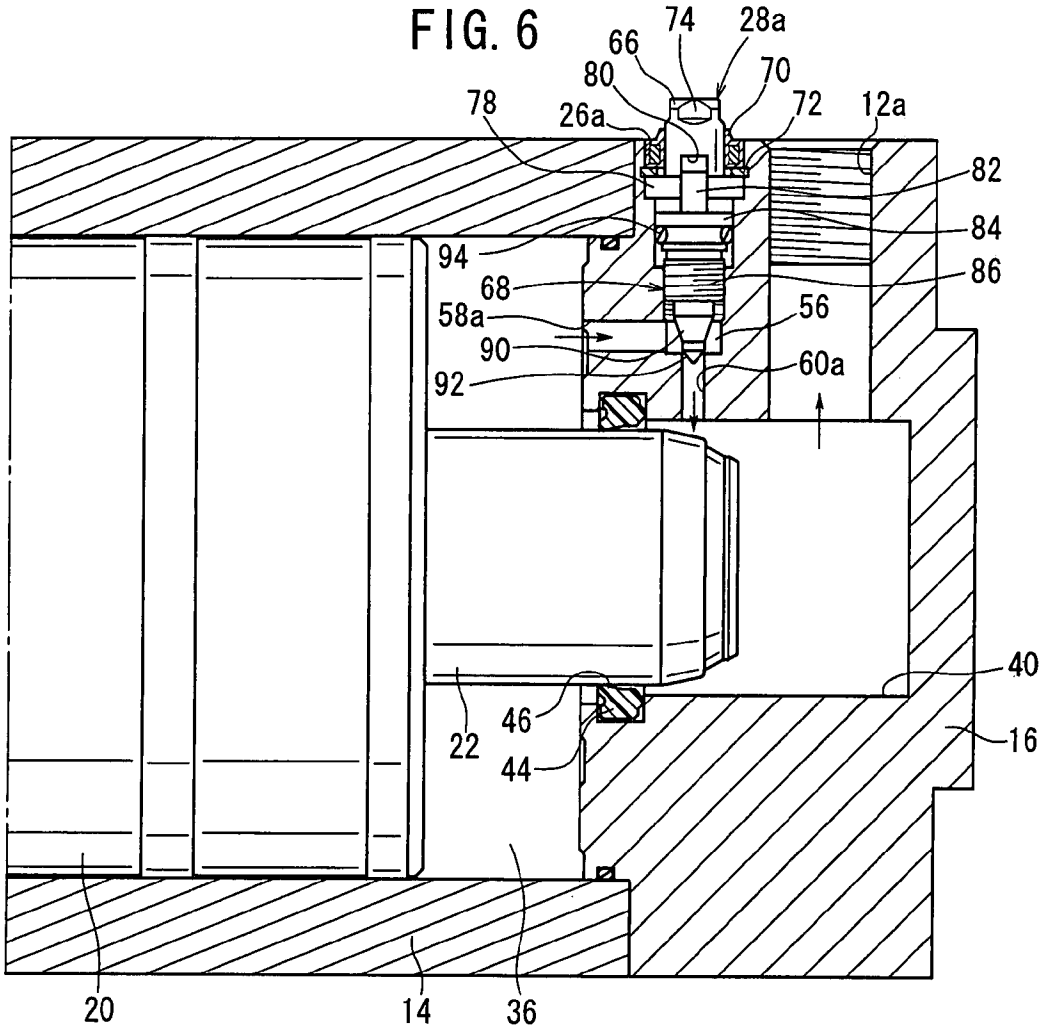
FIG. 6 is a partial magnified longitudinal sectional view showing that the piston of the cylinder apparatus shown in FIG. 5 is slightly displaced toward a head cover.

Subsequently, when the pressure fluid further flows into the second cylinder chamber 38 from the second port 12*b*, the piston 20 is further displaced toward the head cover 16 by the pressing action of the pressure fluid as shown in FIG. 6. One end of the piston rod 22 is inserted into the first communication chamber 40.

In this situation, one end of the piston rod 22 is inserted into the first communication chamber 40, and the outer circumferential surface thereof is surrounded by the first rod packing 44. Therefore, the pressure fluid in the first cylinder chamber 36 is prevented from flowing directly to the first communication chamber 40.

That is, the pressure fluid in the first cylinder chamber 36 is prevented from flowing into the first communication chamber 40 by the sealing of the first rod packing 44. Therefore, the pressure fluid in the first cylinder chamber 36 flows to the communicating section 56 of the first installation hole 26*a* via the first bypass passage 58*a*. The pressure fluid flows to the second bypass passage 60*a* via the clearance between the second tapered section 92 of the needle 68 and the opening of the second bypass passage 60*a*. The pressure fluid passes through the second bypass passage 60*a*, and the pressure fluid is discharged to the outside from the second port 12*b* via the first communication chamber 40.

During this process, as shown in FIG. 5, the flow rate of the pressure fluid is decreased when the pressure fluid in the first cylinder chamber 36 is discharged to the outside from the first port 12*a* via the first and second bypass passages 58*a*, 60*a*, as compared with the case in which the pressure fluid in the first cylinder chamber 36 directly flows to the first communication chamber 40 to be discharged to the outside from the first port 12*a*.

In other words, the pressure fluid remaining in the first cylinder chamber 36 generates displacement resistance when the piston 20 is displaced toward the head cover 16. Accordingly, the displacement speed of the piston 20 is lowered.

Figure 7:
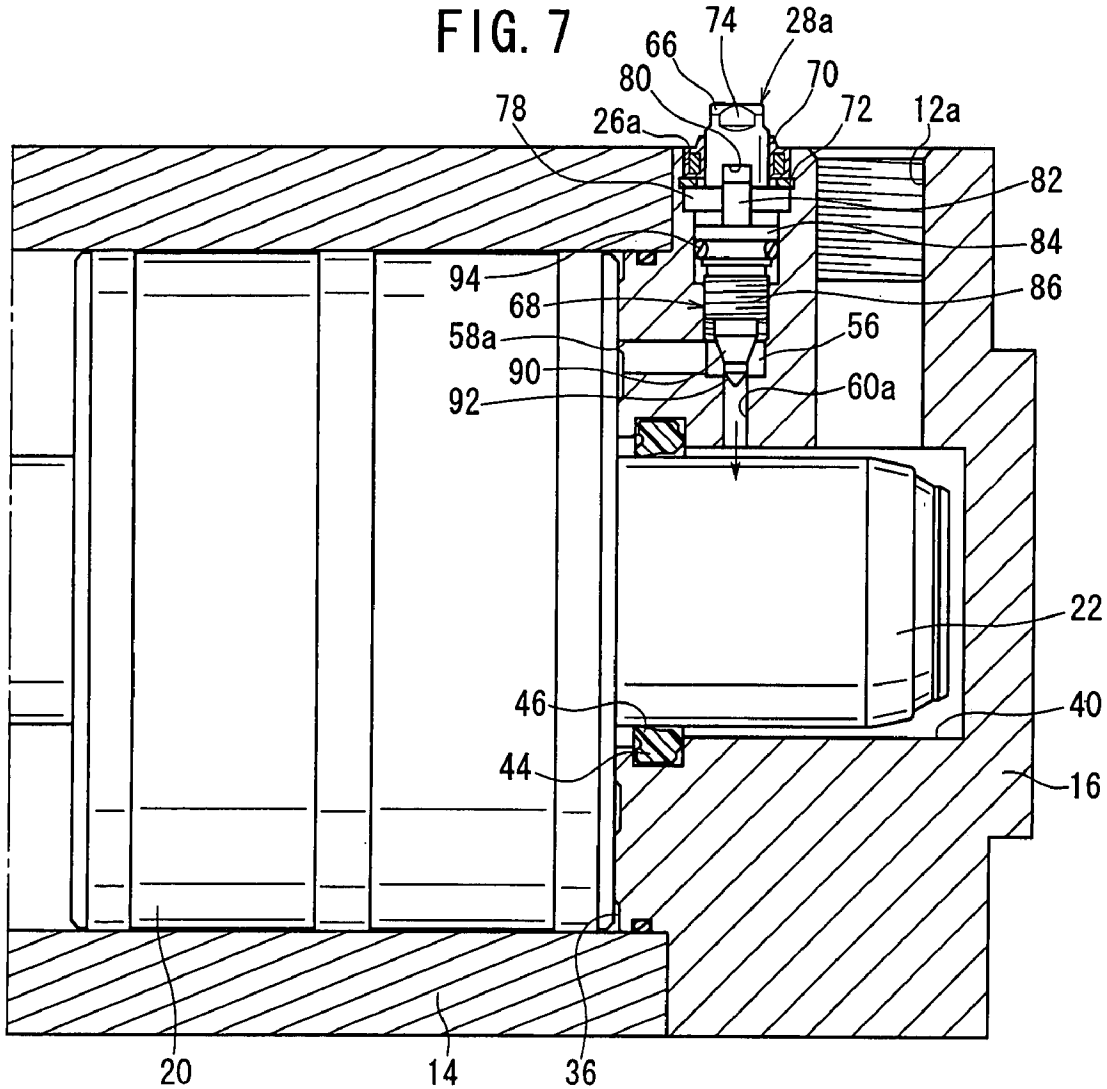
FIG. 7 is a partial magnified longitudinal sectional view showing that the piston of the cylinder apparatus shown in FIG. 5 abuts against the head cover.
Figure 8:
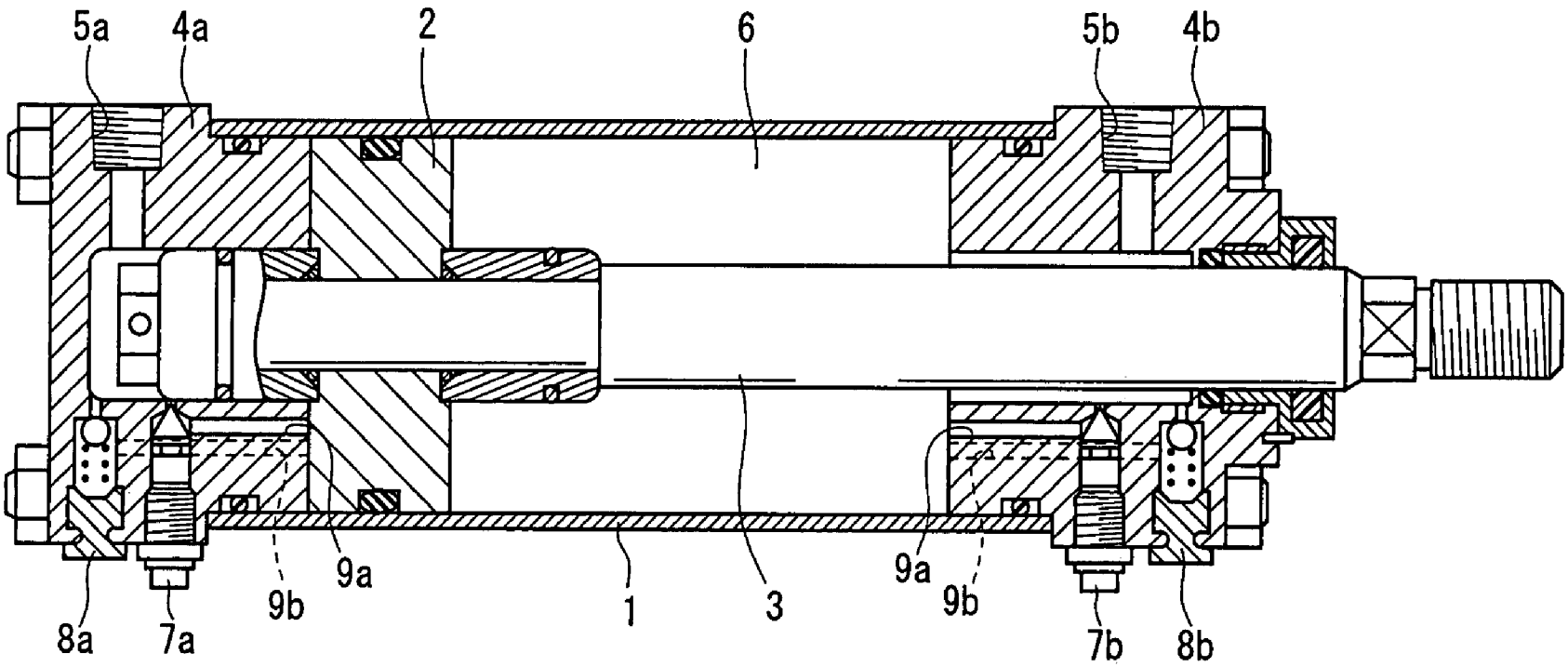
FIG. 8 PRIOR ART
FIG. 8 is, with partial omission, a longitudinal sectional view illustrating a conventional cylinder apparatus.

As a result, the displacement speed of the piston 20 can be gradually decreased before the piston 20 arrives at the end of displacement on the side of the head cover 16. Therefore, it is possible to absorb the shock when the piston 20 is displaced toward the head cover 16 and the piston 20 arrives at the head cover 16 (see FIG. 7).

As described above, in the embodiment of the present invention, the throttle valves 28*a*, 28*b* are installed to the first and second installation holes 26*a*, 26*b* of the head cover 16 and the rod cover 18. The rotatable member 66 of each of the throttle valves 28*a*, 28*b* is fastened by the stopper ring 72 so that the rotatable member 66 is not displaced in the axial direction.

When the displacement speed of the piston 20 around the end of displacement is adjusted by using the throttle valve 28*a*, 28*b*, the rotatable member 66 is rotated to displace the needle 68 in the axial direction, and thus the engaging projection 82 of the needle 68 is displaced in the axial direction in the engaging recess 80 of the rotatable member 66. In this situation, the depth of the engaging recess 80 has a depth such that the upper end of the engaging projection 82 does not contact the upper surface of the engaging recess 80 when the engaging projection 82 is displaced in the upward direction. Therefore, the rotatable member 66 is not pressed upwardly when the needle 68 is displaced in the axial direction.

Therefore, when the needle 68 engaged with the rotatable member 66 is displaced in the axial direction, the displacement of the needle 68 in the axial direction is absorbed by the engaging recess 80, and the rotatable member 66 is not displaced in the axial direction.

As a result, even when the rotatable member 66 is rotated to control the flow rate of the pressure fluid flowing through each of the first bypass passages 58*a*, 58*b* and the second bypass passages 60*a*, 60*b*, the amount of protrusion of the throttle valve 28*a*, 28*b* from the head cover 16 and the rod cover 18 is not changed, but is always constant. Therefore, even when the displacement speed of the piston 20 is adjusted by using the throttle valves 28*a*, 28*b*, the outer shape of the cylinder apparatus 10 is not changed.

Further, the displacement of the rotatable member 66 in the axial direction is preferably prevented by the stopper ring 72. The rotatable member 66 is not recessed from the upper surface of each of the head cover 16 and the rod cover 18 to which the rotatable member 66 is installed. Therefore, even when liquid or the like is used in the vicinity of the cylinder apparatus 10, the liquid and the dust or the like are prevented from being collected in the first and second installation holes 26*a*, 26*b* installed with the throttle valves 28*a*, 28*b*.

What is claimed is:

1. A cylinder apparatus comprising a cylinder body having a cylinder chamber defined therein, a cover member that closes said cylinder chamber, a piston installed in said cylinder body which is displaceable in an axial direction in said cylinder chamber, a port provided in said cover member for supplying and discharging a pressure fluid, and a cushion mechanism which adjusts a displacement speed around an end of displacement of said piston, wherein said cushion mechanism comprises:

a bypass passage which communicates with said port and said cylinder chamber;

an adjusting member which is displaceably screwed within said cylinder apparatus and which has an engaging projection; and a rotatable member having an engaging recess, which is rotatably installed within said cylinder apparatus, and which is prevented from displacement in a direction substantially perpendicular to an axis of said cylinder body, wherein said engaging recess of said rotatable member engages with said engaging projection of said adjusting member when said rotatable member is rotated, said adjusting member faces said bypass passage, and a flow rate of said pressure fluid flowing through said bypass passage is adjusted when said adjusting member only is displaced in said direction substantially perpendicular to said axis of said cylinder body, wherein said rotatable member has a columnar holding section, and a flange section which is formed under said holding section and which is expanded radially outwardly, and wherein a stopper ring, which prevents displacement of said rotatable member, is installed in said holding section by a ring-shaped covering member.

2. The cylinder apparatus according to claim 1, wherein said rotatable member is installed in an installation hole formed in said cylinder apparatus, and said rotatable member is prevented from displacement by a fastening member installed in said installation hole.

3. The cylinder apparatus according to claim 2, wherein said cover member includes a head cover which is secured to one end of said cylinder body, and a rod cover which is secured to the other end of said cylinder body.

4. The cylinder apparatus according to claim 2, wherein said installation hole includes a first hole section which is formed on an outer surface of said cylinder apparatus, a second hole section which has a diameter reduced in a direction directed from said first hole section to said cylinder chamber, a female thread section which is formed in a direction directed from said second hole section to said cylinder chamber, and a communicating section which is formed in a direction directed from said female thread section to said cylinder chamber.

5. The cylinder apparatus according to claim 4, wherein said communicating section is provided at an intersection between a first bypass passage section, which extends substantially in parallel to an axis of a piston rod, and a second bypass passage section, which extends in a direction substantially perpendicular to said axis of said piston rod.

6. The cylinder apparatus according to claim 1, wherein said flange section has substantially the same diameter as an inner circumferential diameter of a first hole section of an installation hole, and a lower surface of said flange section abuts against a bottom surface of said first hole section.

7. The cylinder apparatus according to claim 1, wherein a clearance is always formed in a displacement direction of said adjusting member between said engaging recess and said engaging projection.

8. The cylinder apparatus according to claim 1, wherein said adjusting member comprises a needle, and said needle includes said engaging projection which is formed at an upper portion, a guide section which is formed under said engaging projection, a screw section which is formed under said guide section, and a tapered section which is formed under said screw section and which faces said bypass passage.

9. The cylinder apparatus according to claim 1, wherein said covering member is formed of an elastic material, and a ring member of a metal material is provided in said covering member.

10. A cylinder apparatus comprising a cylinder body having a cylinder chamber defined therein, a cover member that closes said cylinder chamber, a piston installed in said cylinder body which is displaceable in an axial direction in said cylinder chamber, a port provided in said cover member for supplying and discharging a pressure fluid, and a cushion mechanism which adjusts a displacement speed around an end of displacement of said piston, wherein said cushion mechanism comprises:

a bypass passage which communicates with said port and said cylinder chamber;

an adjusting member which is displaceably screwed within said cylinder apparatus and which has an engaging projection; and a rotatable member having an engaging recess, which is rotatably installed within said cylinder apparatus, and which is prevented from displacement in a direction substantially perpendicular to an axis of said cylinder body, wherein said engaging recess of said rotatable member engages with said engaging projection of said adjusting member when said rotatable member is rotated, said adjusting member faces said bypass passage, and a flow rate of said pressure fluid flowing through said bypass passage is adjusted when said adjusting member only is displaced in said direction substantially perpendicular to said axis of said cylinder body, wherein said rotatable member has a columnar holding section, and a flange section which is formed under said holding section and which is expanded radially outwardly, and wherein said flange section has substantially the same diameter as an inner circumferential diameter of a first hole section of an installation hole, and a lower surface of said flange section abuts against a bottom surface of said first hole section.

11. The cylinder apparatus according to claim 10, wherein said rotatable member is installed in an installation hole formed in said cylinder apparatus, and said rotatable member is prevented from displacement by a fastening member installed in said installation hole.

12. The cylinder apparatus according to claim 11, wherein said cover member includes a head cover which is secured to one end of said cylinder body, and a rod cover which is secured to the other end of said cylinder body.

13. The cylinder apparatus according to claim 11, wherein said installation hole includes a first hole section which is formed on an outer surface of said cylinder apparatus, a second hole section which has a diameter reduced in a direction directed from said first hole section to said cylinder chamber, a female thread section which is formed in a direction directed from said second hole section to said cylinder chamber, and a communicating section which is formed in a direction directed from said female thread section to said cylinder chamber.

14. The cylinder apparatus according to claim 13, wherein said communicating section is provided at an intersection between a first bypass passage section, which extends substantially in parallel to an axis of a piston rod, and a second bypass passage section, which extends in a direction substantially perpendicular to said axis of said piston rod.

15. The cylinder apparatus according to claim 10, wherein a stopper ring, which prevents displacement of said rotatable member, is installed in said holding section by a ring-shaped covering member.

16. The cylinder apparatus according to claim 10, wherein a clearance is always formed in a displacement direction of said adjusting member between said engaging recess and said engaging projection.

17. The cylinder apparatus according to claim 10, wherein said adjusting member comprises a needle, and said needle includes said engaging projection which is formed at an upper portion, a guide section which is formed under said engaging projection, a screw section which is formed under said guide section, and a tapered section which is formed under said screw section and which faces said bypass passage.

18. The cylinder apparatus according to claim 15, wherein said covering member is formed of an elastic material, and a ring member of a metal material is provided in said covering member.

* * * * *